US009381625B2

(12) United States Patent
Chen et al.

(10) Patent No.: US 9,381,625 B2
(45) Date of Patent: Jul. 5, 2016

(54) ELECTRICAL WRENCH

(71) Applicant: CHERVON (HK) LIMITED, Wanchai (HK)

(72) Inventors: Liang Chen, Nanjing (CN); Qiwei Zhou, Nanjing (CN); Wu Chen, Nanjing (CN)

(73) Assignee: CHEVRON (HK) LIMITED, Wanchai (HK)

( * ) Notice: Subject to any disclaimer, the term of this patent is extended or adjusted under 35 U.S.C. 154(b) by 275 days.

(21) Appl. No.: 14/096,224

(22) Filed: Dec. 4, 2013

(65) Prior Publication Data

US 2014/0182420 A1 Jul. 3, 2014

(30) Foreign Application Priority Data

| | | |
|---|---|---|
| Dec. 29, 2012 | (CN) | 2012 1 0590066 |
| Dec. 29, 2012 | (CN) | 2012 1 0590179 |
| Dec. 29, 2012 | (CN) | 2012 1 0590614 |
| Feb. 28, 2013 | (CN) | 2013 1 0063713 |
| Feb. 28, 2013 | (CN) | 2013 1 0065014 |
| Feb. 28, 2013 | (CN) | 2013 1 0066543 |

(51) Int. Cl.
*B25B 21/00* (2006.01)
*B25B 13/46* (2006.01)

(52) U.S. Cl.
CPC ..... *B25B 21/004* (2013.01); *B25B 13/463* (2013.01); *B25B 21/00* (2013.01)

(58) Field of Classification Search
CPC .... B25B 21/00; B25B 21/004; B25B 21/002; B25B 21/007; B25B 13/08; B25B 13/463; B25B 13/481; B25B 23/0035
See application file for complete search history.

(56) References Cited

U.S. PATENT DOCUMENTS

| | | | | | |
|---|---|---|---|---|---|
| 3,257,877 | A * | 6/1966 | Ulrich | B25B 21/002 | 173/216 |
| 3,987,692 | A * | 10/1976 | Lesner | B25B 21/002 | 81/57.13 |
| 4,064,772 | A * | 12/1977 | Boyd | B25B 21/002 | 81/57.13 |
| 4,506,567 | A * | 3/1985 | Makhlouf | B25B 17/02 | 81/57.3 |
| 5,355,751 | A * | 10/1994 | Specht | B25B 17/00 | 81/57.14 |
| 5,388,479 | A * | 2/1995 | Sroka | B25B 13/466 | 81/58.2 |
| 5,440,215 | A * | 8/1995 | Gilmore | B23P 19/066 | 173/178 |
| 5,636,698 | A * | 6/1997 | Estep | B25B 21/00 | 173/176 |
| 6,370,987 | B1 * | 4/2002 | Wilson, Jr. | B25B 21/002 | 192/46 |
| 6,559,613 | B1 * | 5/2003 | Elliott | B25B 23/14 | 173/181 |

(Continued)

*Primary Examiner* — David B Thomas
(74) *Attorney, Agent, or Firm* — Greenberg Traurig, LLP

(57) ABSTRACT

An electrical wrench includes a housing, a power member, a reversing mechanism, a support transmission assembly, an opening gear, a main control assembly and a restoring assembly. The housing includes having two projections, for example shaped as claws, arranged oppositely to cooperatively define an entrance. The power member, the reversing mechanism, the support transmission assembly and the opening gear are cooperatively coupled to one another and accommodated in the housing. The opening gear includes an outer teeth portion, an opening and a driving portion in communication with the opening, a tubular member for engaging with a fastener positioned in cooperation with the opening gear through the entrance. The restoring assembly includes an identifying portion, a sensor for sensing the position of the identifying portion, a control circuit board, a restoring switch and a restoring switch operator.

20 Claims, 12 Drawing Sheets

(56) References Cited

U.S. PATENT DOCUMENTS 7,942,084 B2 * 5/2011 Wilson, Jr. ..... B25B 13/481 81/429
8,171,827 B2 * 5/2012 Gareis ..... B25B 21/00 81/469
8,230,942 B2 * 7/2012 Steverding ..... B25B 21/00 173/1
9,010,509 B2 * 4/2015 Kobayashi ..... B25B 21/004 173/104
9,014,933 B2 * 4/2015 Chen ..... F16H 1/28 173/178
2010/0269639 A1 * 10/2010 Sroka ..... B25B 13/463 81/58.2
2012/0103142 A1 * 5/2012 Sroka ..... B25B 13/48 81/57.11
2014/0157961 A1 * 6/2014 Chen ..... B25B 21/026 81/464
2015/0266170 A1 * 9/2015 Weller ..... B25B 21/00 81/57.42

* cited by examiner

ELECTRICAL WRENCH

RELATED APPLICATION INFORMATION

This application claims the benefit of CN 201210590614.0, filed on Dec. 29, 2012, CN 201210590179.1, filed on Dec. 29, 2012, CN 201210590066.1, filed on Dec. 29, 2012, CN 201310065014.7, filed on Feb. 28, 2013, CN 201310063713.8, filed on Feb. 28, 2013, and CN 201310066543.9, filed on Feb. 28, 2013 the disclosures of which are incorporated herein by reference in their entirety.

FIELD

The subject disclosure generally relates to electrical tools and, more particularly, to an electrical wrench

BACKGROUND

The wrench is widely used in daily life, and is generally used to tighten or release a fastener, such as a nut with a bolt. Common wrenches are categorized into the open-end wrench and the ratchet wrench. Generally, a fastener can be arranged in the open-end wrench through the opening on one side of the wrench. During the tightening or releasing operation, the wrench needs to be removed from the fastener after rotating the fastener a relatively small angle, and then the wrench is positioned at another angle on the fastener so as to continue to rotate the fastener. This process needs to be repeated several times until the fastener is completely tightened or released, thus the operation is not convenient. Moreover, the open-end wrench cannot be used in some narrow spaces. As for the ratchet wrench, the entrance portion thereof is generally configured as a closed structure, and then the ratchet wrench needs to surround the fastener from the upper portion or the lower portion thereof in order to tighten or release the fastener, thus the operation is also not convenient.

To enhance the working efficiency and the convenience of the fastening operation, there are some electrical wrenches in the market. However, these known electrical wrenches are seen to have limited usefulness owing to the manner in which they are constructed.

SUMMARY

The following describes an improved electrical wrench, i.e., an electrical wrench which can be used in more applications, for example in a narrow space, and more conveniently when compared to currently known electrical wrenches.

More particularly, the following describes an electrical wrench for rotating a fastener wherein the electrical wrench includes a housing having a handling portion and a mounting portion extending from one end of the handling portion along a length direction. The mounting portion includes two claws arranged oppositely and the two claws cooperatively defining an entrance therebetween. The electrical wrench additionally includes a power member, a reversing mechanism, a support transmission assembly, and an opening gear where the power member, the reversing mechanism, the support transmission assembly and the opening gear are coupled and accommodated in the housing. The opening gear is rotatably arranged in the mounting portion and includes an outer teeth portion for engaging with the support transmission assembly, an opening corresponding to the entrance, and a driving portion communicated with the opening. The widths of the entrance and the opening are greater than or equal to the diameter or width of a tubular or cylinder member cooperated with the fastener. The driving portion is capable of driving the fastener or an accessory to rotate. Also included are a main control assembly and a restoring assembly. The restoring assembly includes an identifying portion for identifying the position of the opening of the opening gear and is arranged in a predetermined position of the opening gear or a predetermined position of the reversing mechanism. A sensor is also provided for sensing the position of the identifying portion. A control circuit board is connected with the sensor and a restoring switch is used to trigger a restoring function. When the restoring switch is triggered, the sensor is capable of sensing the identifying member and generates an electrical signal which is transmitted to the control circuit board so that the control circuit board controls the electrical wrench to stop rotating.

In some circumstances, the main control assembly includes a main switch, a main switch operator and a switch driving member, the main switch operator and the restoring switch operator are arranged on opposite sides of the handling portion of the housing, the switch driving member is arranged between the main switch operator and a restoring switch operator, the control circuit board is provided with a control circuit for controlling the power member and the switch driving member is capable of switching on/off the control circuit under the driving action of the main switch operator and the restoring switch operator.

In some circumstances, the restoring switch operator includes a first lever and a second lever for respectively pushing the switch driving member to switch on/off the main switch and the restoring switch; the switch driving member is rotatably mounted to the housing and includes a first rotating arm and a second rotating arm respectively abutting against the main switch operator and the first lever of the restoring switch operator, a linkage member for driving the main switch to switch on/off and an elastic restoring member; under the action of the elastic restoring member, the first rotating arm is capable of abutting against the main switch operator or the second rotating arm abutting against the restoring switch operator.

In some circumstances, the housing is configured as a substantially rod-type structure including a main housing extending along the longitudinal direction and a support housing extending from one end of the main housing, a first end of the support housing is fixedly mounted in the main housing and a second end of the support housing opposite to the first end extends out of the main housing along the length direction of the housing, the mounting portion is formed on the end of the support housing away from the main housing and including two substantially arc-shaped claws arranged oppositely, and the two claws cooperatively define an accommodating hole communicated with the entrance and the opening gear is received in the accommodating hole.

In some circumstances, the reversing mechanism is a ratchet mechanism or a bevel gear mechanism, and a speed reducing mechanism is arranged between the power member and the reversing mechanism, by which, after decelerating, the power provided by the power member is transmitted to the reversing mechanism.

In some circumstances, the reversing mechanism is a ratchet mechanism including an eccentric shaft, a swinging member, a pawl and a ratchet, the eccentric shaft is pivotally connected to the support housing and connected with an output shaft of the power member by the speed reducing mechanism, the pawl is pivotally connected to the swinging member, the ratchet includes an inner ring having a plurality of ratchet teeth for mating with the pawl and an outer ring having an outer teeth ring for engaging with the support transmission assembly, under the action of the swinging member, the pawl is capable of being rotated in a first or second direction around a pivoting axis substantially perpendicular to a plane in which the swinging member is located, when the pawl rotates in the first direction, it inserts into the ratchet teeth to push the ratchet to rotate in the same direction, and when the pawl rotates in the second direction, it slips over the ratchet so that the ratchet stops rotating.

In some circumstances, the power member includes a motor and a power supply for providing electrical power to the motor, the speed reducing mechanism is a planet gear speed reducing mechanism including a planet gear, an inner teeth ring, a planet carrier and a sun gear, the sun gear is connected to the output shaft of the motor without rotation, the planet gear is engaged with the sun gear and the inner teeth ring respectively, the inner teeth ring is fixedly mounted to the support housing, under the driving action of the sun gear, the planet gear is capable of being rotated on its own axis and revolved around the output shaft of the motor along the inner teeth ring; the planet carrier is fixedly provided with a projecting planet gear shaft correspondingly around which the planet gear is rotatably mounted, and the planer carrier is connected to the eccentric shaft without rotation.

In some circumstances, the reversing mechanism includes a reverser having a rotating shaft, an elastic assembly and an operator, the swinging member is pivotally connected to the support housing by the rotating shaft, one end of the elastic assembly abuts against the rotating shaft and the other end of the elastic assembly abuts against the pawl; the pawl includes a first pawl portion and a second pawl portion arranged symmetrically with each other along the pivoting shaft; the elastic assembly is capable of being rotated under the action of the rotating shaft and abuts against the first pawl portion or the second pawl portion; the operator is connected to the rotating shaft without rotation so that the rotating shaft can be rotated under the action of the operator to change the abutting position of the elastic assembly on the pawl, thereby effecting a reverse action; the rotating shaft defines a positioning hole; the elastic assembly includes a compression spring and a hollow pin, the compression spring includes a first end abutting against an inner wall of the hollow pin and a second end received in the positioning hole of the rotating shaft, and the hollow pin abuts against the pawl under the action of the compression spring.

In some circumstances, the swinging member includes a swinging body and a protection cover for cooperating with the swinging body, the ratchet is arranged between the swinging body and the protection cover, each of the swinging body and the protection cover defines a rotating shaft hole concentric with the ratchet and an assembling hole in which a screw is accommodated so as to fixedly connect the swinging body to the protection cover; the rotating shaft is passed through the rotating shaft holes of the swinging body and the protection cover so that the swinging body and the protection cover can rotate relative to the rotating shaft, and the two ends of the rotating shaft are supported on the support housing and rotatable relative to the support housing.

In some circumstances, at least one of the swinging body and the protection cover includes a circular boss formed at one side of one of the swinging body and the protection cover adjacent to the other of the swinging body and the protection cover, the rotating shaft hole is arranged in the center of the circular boss, the assembling hole is arranged on the circular boss, the circular boss further defines a pivoting shaft hole for pivotally mounting the pawl, and the pivoting shaft hole and the assembling hole are arranged on opposite sides of the circumferential direction of the circular boss.

In some circumstances, the support transmission assembly includes two transmission gears, the two sides of each transmission gear is engaged with the opening gear and the reversing mechanism respectively, the size of the opening of the opening gear is smaller than the maximum engaging distance between the two transmission gears and the opening gear, and the widths of the entrance and the opening is greater than or equal to the diameter or the width of a tubular or cylinder member which is capable of engaging with the screwed member.

From the foregoing and the description which follows, it will be appreciated that the subject electrical wrench provides an opening gear with an opening corresponding to the entrance so that the fastener may be inserted into the opening gear by the portion to be tightened or released, thus the electrical wrench can be simply used many different types of applications, such as for use with a relatively long bolt or a nut with the tube. Moreover, after being used, the opening of the opening gear may be aligned with the entrance by the restoring assembly for the next operation. With the power supplied by the motor, during operation, the user need only put the fastener into the opening gear and then actuate the electrical wrench, thus the fastener may be tightened or released without rotating the housing. The subject electrical wrench therefore has a simple and convenient operation and high working efficiency, and may be simply used in a wide variety of applications, including in some narrow operating spaces.

DETAILED DESCRIPTION

To better understand the technical content of the subject electrical wrench an exemplary embodiment will be explained with reference to the drawings.

Figure 1:
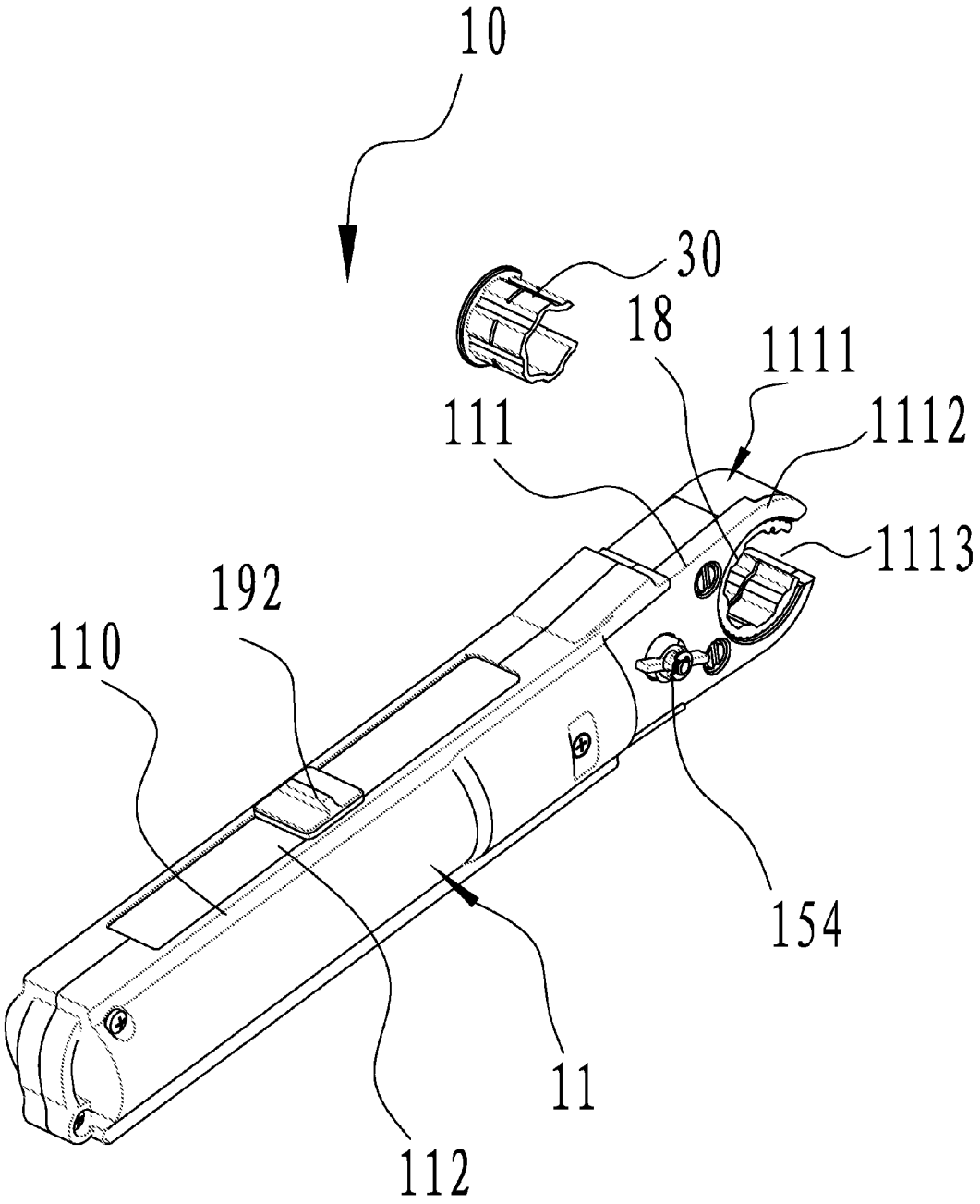
FIG. 1 is a schematic view of the whole structure of an exemplary electrical wrench constructed according to the description which follows.
Figure 2:
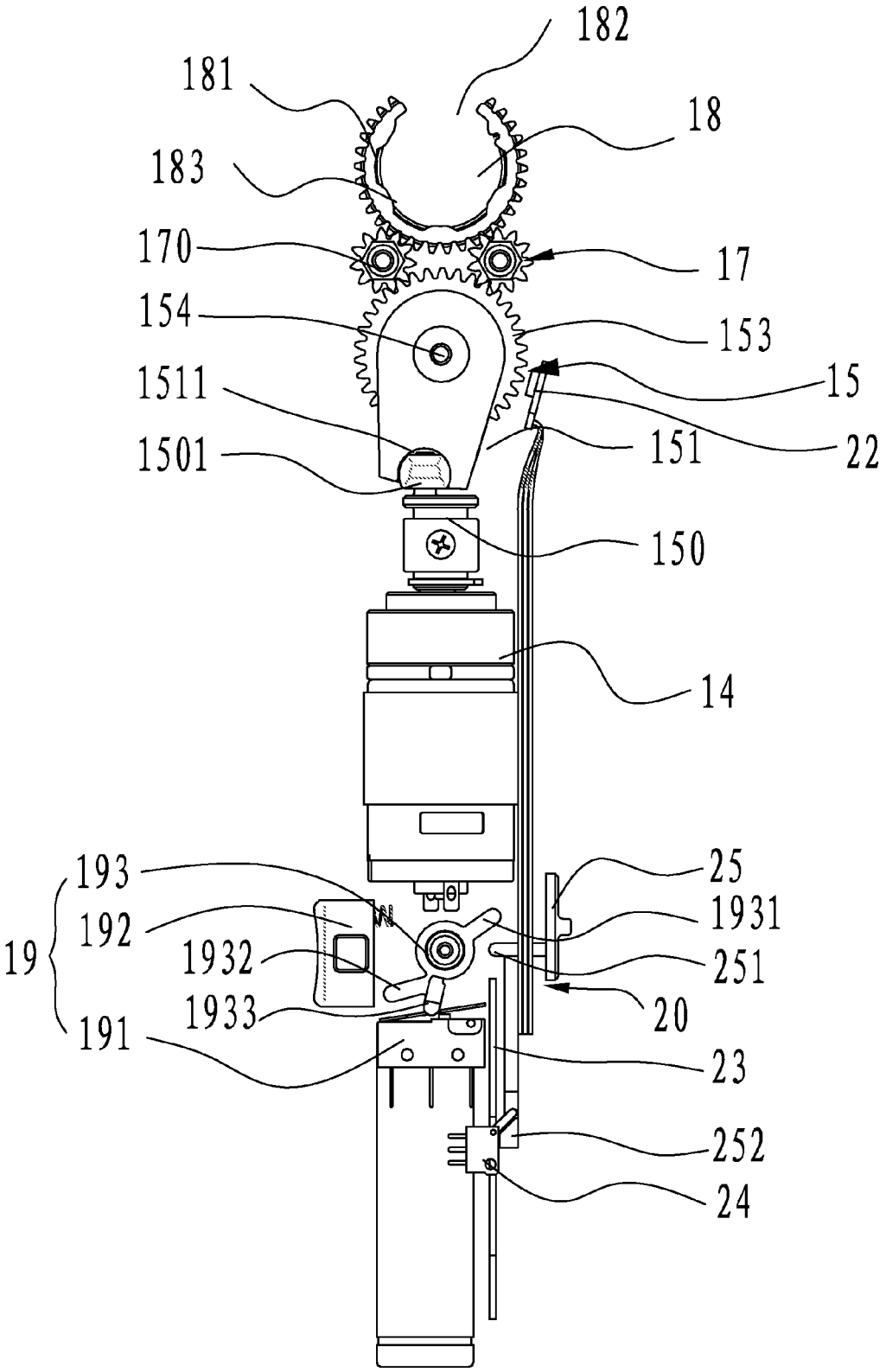
FIG. 2 is a front view of the electrical wrench of FIG. 1 with the housing removed.
Figure 3:
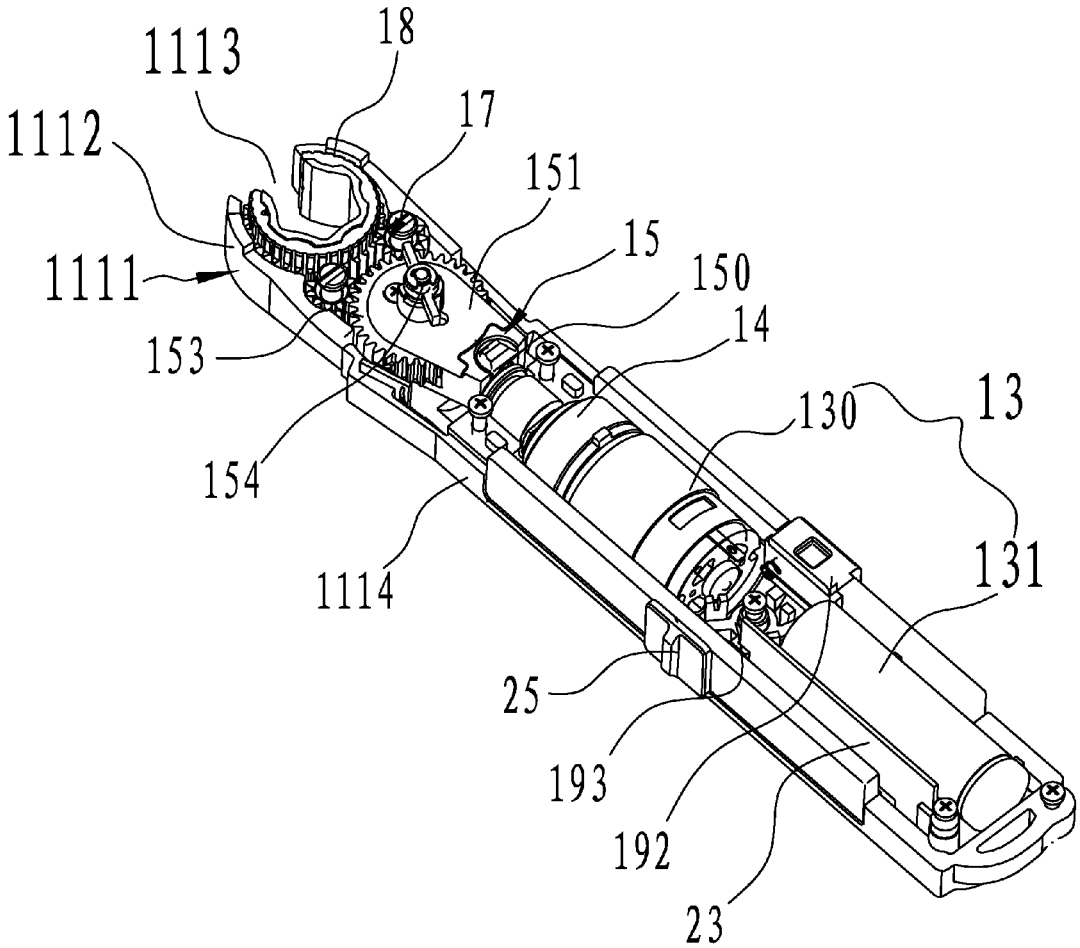
FIG. 3 is a schematic view of the electrical wrench of FIG. 1 with the housing and the upper support carrier removed.

Referring to FIGS. 1-3, an exemplary electrical wrench 10 includes a housing 11, a power member 13, a speed reducing mechanism 14, a reversing mechanism 15, a support transmission assembly 17, an opening gear 18, a main control assembly 19 and a restoring assembly 20.

The housing 11 is configured as a substantially rod-type structure, and includes a main housing 110 extending along the longitudinal direction and a support housing 111 extending from one end of the main housing 110. The power member 13, the speed reducing mechanism 14, the reversing mechanism 15, the support transmission assembly 17 and the opening gear 18 are coupled to one another and accommodated in the housing 11.

Figure 4:
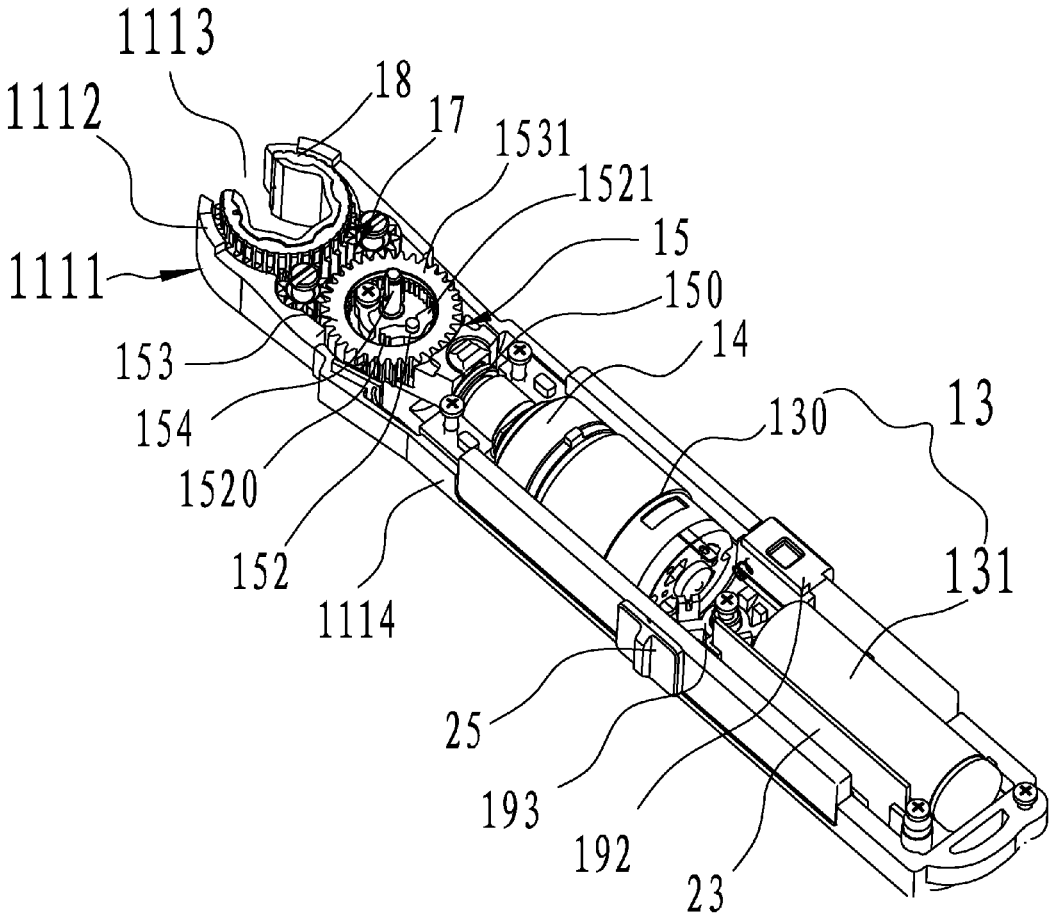
FIG. 4 is a schematic view of FIG. 3 with the protection cover of the swinging member removed.
Figure 5:
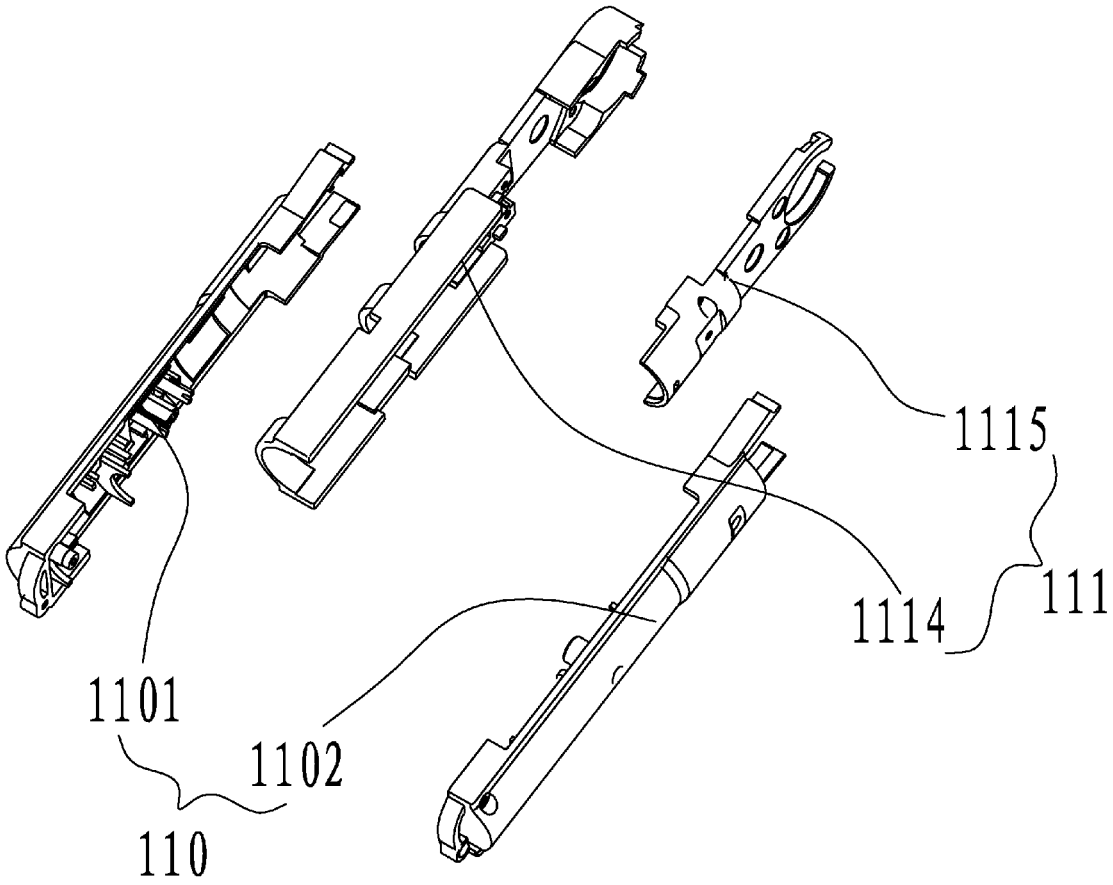
FIG. 5 is an exploded, perspective view of the housing of the electrical wrench of FIG. 1.

Also referring to FIGS. 3-5, the main housing 110 includes a first half 1101 and a second half 1102 coupled with each other and fastened by screws. The first half 1101 and the second half 1102 cooperatively define an accommodating chamber for receiving the power member 13, the speed reducing mechanism 14 and one end of the support housing 111. The first half 1101 and the second half 1102 may also be coupled with each other by interference fit connection, locking connection, inserting connection or pin connection, etc. and those connection manners which enable the first half 1101 and the second half 1102 to be coupled tightly and disassembled simply.

One end of the support housing 111 is formed with a mounting portion 1111. The mounting portion 1111 has two substantially arc-shaped claws 1112 arranged oppositely, an accommodating hole and an entrance 1113 in communication with the accommodating hole are formed between the two claws 112. The accommodating hole is used to accommodate the opening gear 18. The support housing 111 includes a first end fixedly mounted in the main housing 110 and a second end opposite to the first end extending out of the main housing 110 along the length direction of the housing 11. In order to ensure the strength of the electrical wrench 10 during manual operation, the first end of the support housing 111 extends to the handling portion 112 of the housing 11. In the illustrated embodiment, the support housing 111 includes a first support carrier 1114 and a second support carrier 1115. The first support carrier 1114 is an aluminum member or a precisely casted member formed in one piece, and the second support carrier 1115 is a cover corresponding to the structure of the first support carrier 1114. The first support carrier 1114 and the second support carrier 1115 are locked with each other, thus the electrical wrench 10 has a compact structure and high torsional strength, and then can be used to transmit a relatively large torque.

During operation, the electrical wrench 10 may surround the object upon which the fastener is to be screwed or which is a part of the fastener, e.g., in the case of a bolt, from one side through the entrance 1113, and then the fastener is mounted in the driving portion so as to be tightened or released, thus the electrical wrench 10 may be simply used for relatively long bolts, screw nuts with a pipeline, or used in the relatively narrow operating space.

The power member 13 is used to provide power to the reversing mechanism 15, and includes a motor 130 and a power supply 131 for providing power to the motor 130. In the illustrated embodiment, the power supply 131 is a battery, for example, a lithium battery or a Nickel-metal Hydride battery. It should be noted that it is also possible to replace the battery in the housing 11 with an external power supply, for example, an AC power supply, to directly supply the power. In this case, the power member is an AC motor.

Figure 6:
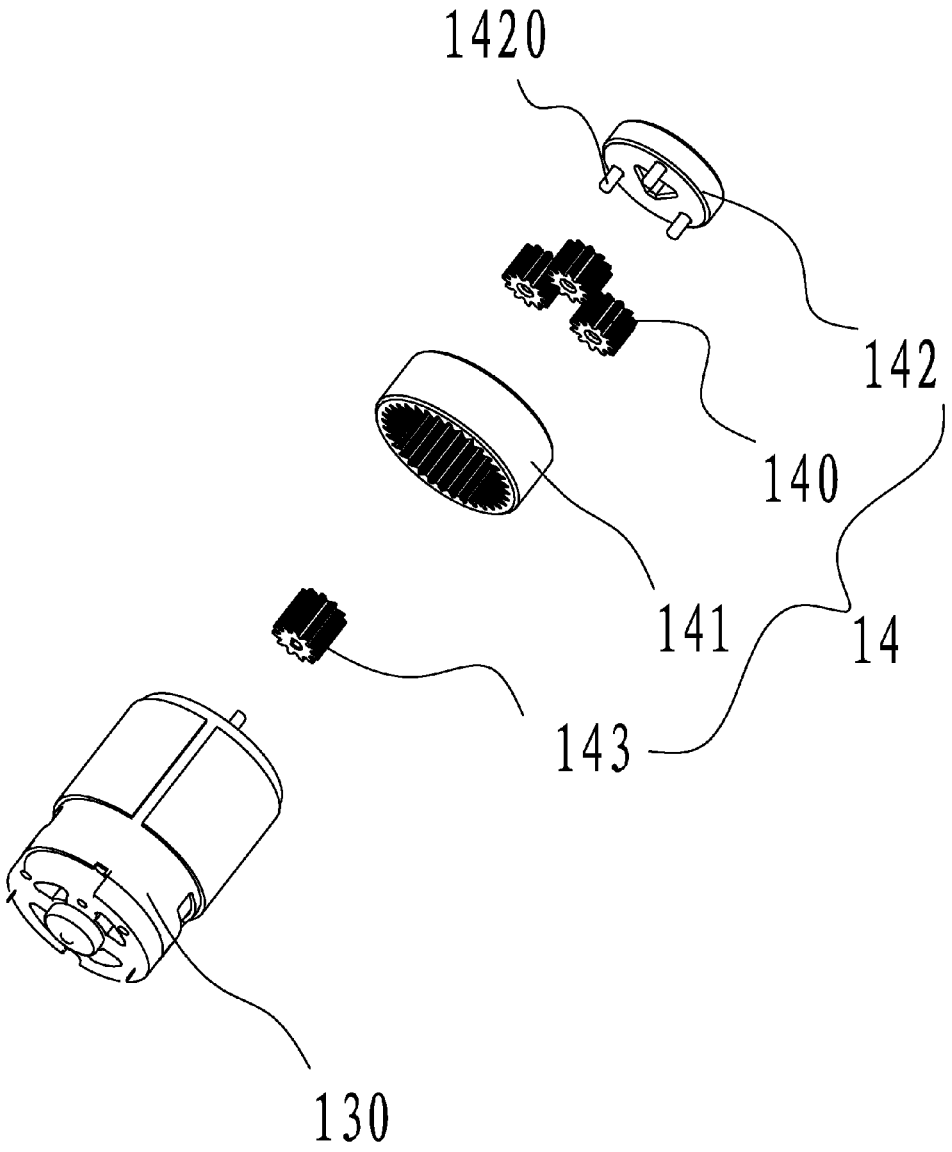
FIG. 6 is an exploded, perspective view of the motor and the speed reducing mechanism of the electrical wrench of FIG. 1.

Referring to FIG. 6, the speed reducing mechanism 14 is used to transmit the power provided by the power member 13 to the reversing mechanism 15, and has a power output end connected with the reversing mechanism 15. The speed reducing mechanism 14 is arranged between the power member 13 and the reversing mechanism 15 to reduce the rotating speed of the motor 130 so as to increase the torque.

In this illustrated embodiment, in order to make the structure of the electrical wrench 10 more compact and transmit larger torque with higher transmitting efficiency, the speed reducing mechanism 14 is a planet gear speed reducing mechanism including a planet gear 140, an inner teeth ring 141, a planet carrier 142 and a sun gear 143.

The inner teeth ring 141 is fixedly mounted in the housing 11. In order to keep a smooth transmission, more than one planet gear 140 is uniformly distributed in the inner teeth ring 141 and engaged with the inner teeth ring 141. In this illustrated embodiment, the number of planet gears 140 is three. The sun gear 143 is connected to the output shaft of the motor 130 without rotation, and the planet gear 140 is engaged with the sun gear 143. The planet gear 140 rotates on its own axis under the driving action of the sun gear 143 and revolves around the output shaft of the motor 130 along the inner teeth ring 141. The planet carrier 142 is provided with three projecting planet gear shafts 1420, and the planet gear 140 surrounds the planet gear shafts 1420 and rotates relative to the planet gear shaft 1420. The planet carrier 142 rotates around the output shaft of the motor 130 under the action of the planet gear 140, and is connected with the reversing mechanism 15 so as to transmit the power to the reversing mechanism 15. It should be noted that the illustrated embodiment is not intended to be limiting as the speed reducing mechanism 14 need not be limited to the planet gear speed reducing mechanism shown. Rather, considering this disclosure it will be understood that other speed reducing mechanisms, such as a bevel gear speed reducing mechanism, may be utilized.

Figure 7:
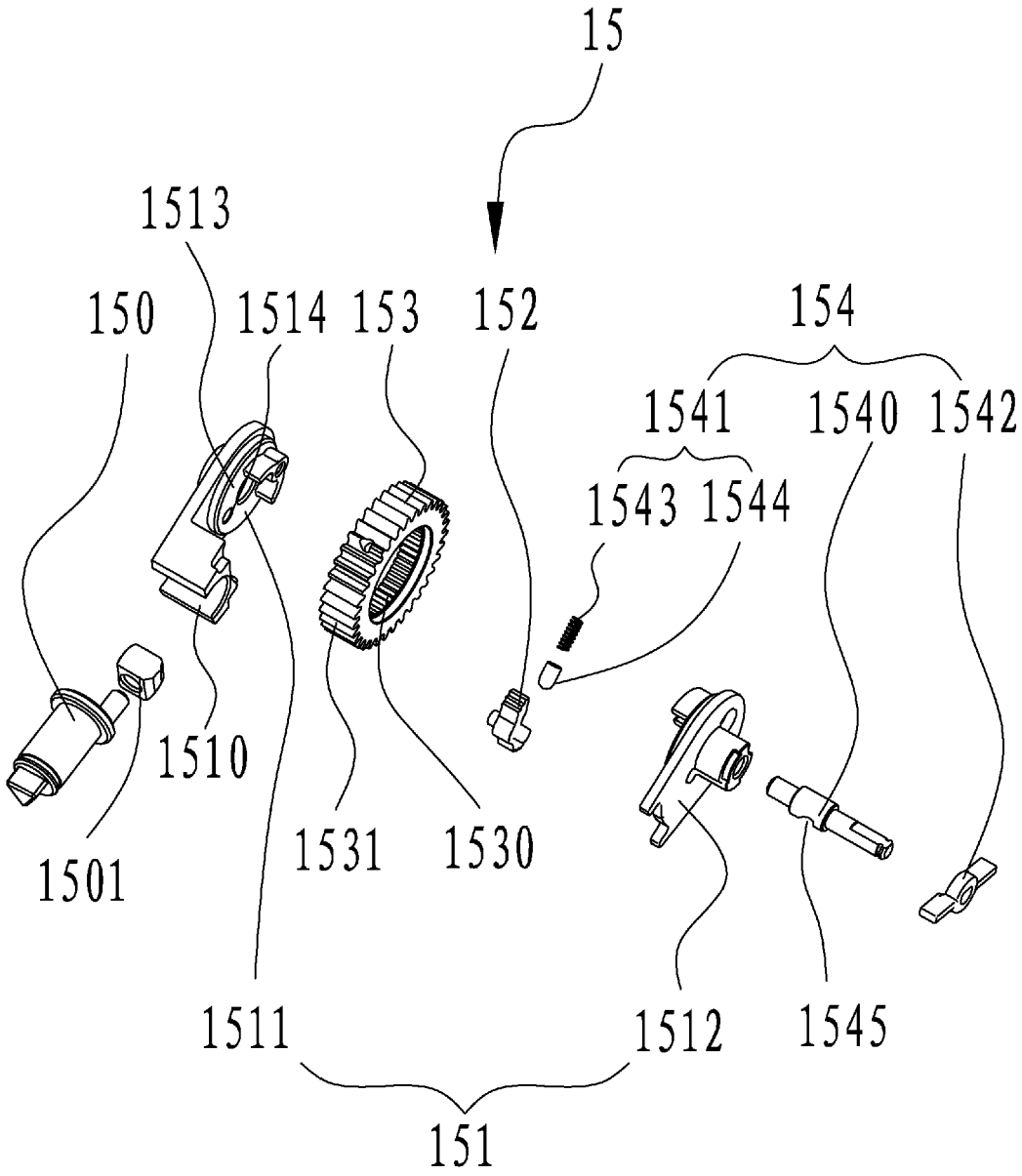
FIG. 7 is an exploded, perspective view of a ratchet mechanism of the electrical wrench of FIG. 1.

Referring to FIGS. 3 and 7, in the illustrated embodiment, the reversing mechanism 15 is configured as a ratchet mechanism including an eccentric shaft 150, a swinging member 151, a pawl 152 and a ratchet 153. One end of the eccentric shaft 150 is connected to the planet carrier 142 without rotation, and the other end of the eccentric shaft 150 is provided with an eccentric portion. The eccentric portion is connected with the swinging member 151 to convert the rotating motion of the output shaft of the motor around its axis into a reciprocating motion of the swinging member 151 around its pivoting shaft. The swinging member 151 is pivotally connected to the support housing 111 and provided with a groove 1510 corresponding to the eccentric portion of the eccentric shaft 150. The eccentric portion is surrounded with a driving sleeve 1501 for cooperating with the groove 1510. The driving sleeve 1501 rotates eccentrically around the central axis of the eccentric shaft 150, and during the eccentric rotation, the driving sleeve 1501 forces the swinging member 151 to swing reciprocatingly and periodically around the pivoting shaft.

It should be noted that the reversing mechanism 15 can better reduce the speed and increase the torque, per se, thus the speed reducing mechanism 14 may be omitted if desired. Then, the function of the reversing mechanism 15 for transmitting power can be achieved by connecting the output shaft of the motor 130 with the eccentric shaft 150 of the reversing mechanism 15 or configuring the output shaft of the motor 130 as an eccentric shaft for cooperating with the swinging member 151.

The pawl 152 is pivotally connected to the swinging member 151, and the ratchet 153 is provided with ratchet teeth 1530 for cooperating with the pawl 152. The swinging member 151 can force the pawl 152 to rotate in a first or second direction around a pivoting axis substantially perpendicular to the plane in which the swinging member 151 is located. When the pawl 152 rotates in the first direction, it inserts into the ratchet teeth 1530 to push the ratchet 153 to rotate in the same direction; and when the pawl 152 rotates in the second direction, it slips over the ratchet 153 so that the ratchet 153 stops rotating.

Referring to FIG. 4, in order to make the electrical wrench 10 more compact, the reversing mechanism 15 is configured as an inner engaging structure, the ratchet teeth 1530 are arranged in the inner ring of the ratchet 153, and the outer ring of the ratchet 153 further includes an outer teeth ring 1531 for cooperating with the support transmission assembly 17.

Referring to FIG. 7 again, in order to change the rotating direction of the ratchet 153 easily, the reversing mechanism 15 further includes a reverser 154. The reverser 154 includes a rotating shaft 1540, an elastic assembly 1541 and an operator 1542. The swinging member 151 is pivotally connected to the support housing 111 by the rotating shaft 1540, and the elastic assembly 1541 is configured with one end fixedly connected with the rotating shaft 1540 and the other end abutting against the pawl 152. The pawl 152 has a first pawl portion 1520 and a second pawl portion 1521 arranged symmetrically with each other, and the elastic assembly 1541 can abut against the first pawl portion 1520 or the second pawl portion 1521 under the action of the rotating shaft 1540. When the elastic assembly 1541 abuts against the first pawl portion 1520, and the pawl 152 rotates in the first direction, the first pawl portion 1520 inserts into the ratchet teeth 1530 to push the ratchet 153 to rotate in the same direction; and when the pawl 152 rotates in the second direction, the first pawl portion 1520 slips over the ratchet 153 so that the ratchet 153 stops rotating. When the elastic member 1541 abuts against the second pawl portion 1521 and the pawl 152 rotates in the second direction, the second pawl portion 1521 inserts into the ratchet teeth 1530 to push the ratchet 153 to rotate in the same direction; and when the pawl 152 rotates in the first direction, the second pawl portion 1521 slips over the ratchet 153 so that the ratchet 153 stops rotating. The operator 1542 is connected to the rotating shaft 1540 without rotation and the rotating shaft 1540 may rotate under the action of the operator 1542, so that the elastic assembly 1541 abuts against the first pawl portion 1520 or the second pawl portion 1521, thereby effecting a reverse action.

The elastic assembly 1541 includes a compression spring 1543 and a hollow pin 1544. The rotating shaft 1540 has a positioning hole 1545. One end of the compression spring 1543 abuts against an inner wall of the hollow pin 1544 and the other end is accommodated in the positioning hole 1545 of the rotating shaft 1540. The hollow pin 1544 abuts against the pawl 152 under the action of the compression spring 1543.

In order to facilitate the assembly and protect the ratchet 153 and the pawl 152 in the ratchet 153, the swinging member 151 includes a swinging body 1511 and a protection cover 1512 cooperated with the swinging body 1511. The ratchet 153 is rotatably arranged between the swinging body 1511 and the protection cover 1512. Each of the swinging body 1511 and the protection cover 1512 defines a rotating shaft hole concentric with the ratchet 153 through which the rotating shaft 1540 can pass. The rotating shaft 1540 passes through the rotating shaft holes of the swinging body 1511 and the protection cover 1512 so that the swinging body 1511 and the protection cover 1512 can rotate relative to the rotating shaft 1540. The two ends of the rotating shaft 1540 are supported on the support housing 111 and can rotate relative to the support housing 111.

In order to increase the strength of the swinging body 1511 and facilitate positioning, the swinging body 1511 is provided with a circular boss 1513 on one side adjacent to the protection cover 1512, and the pawl 153 is arranged concentrically with the circular boss 1513. The rotating shaft hole is arranged in the center of the circular boss 1513 of the swinging body 1511. The circular boss 1513 and the protecting cover 1512 defines an assembling hole respectively, a screw can be accommodated in the assembling holes to fixedly connect the swinging body 1511 to the protecting cover 1513. The circular boss 1513 further defines a pivoting shaft hole 1514 for pivotally mounting the pawl 152. In order to avoid the diffraction between the pawl 152 and the assembling screw, the pivoting shaft hole 1514 and the assembling hole are arranged on the two sides the circular boss 1513 along the circumferential direction. It should be noted that the circular boss 1513 may also be arranged on the protection cover 1512, or both the protection cover 1512 and the swinging body 1511, and the pawl 153 rotatably surrounds the circular bosses 1513 so as to make the electrical wrench 10 more compact.

Referring to FIGS. 3 and 4 again, the support transmission assembly 17 is used to transmit the power of the reversing mechanism 15 to the opening gear 18, and the support transmission assembly 17 is engaged with the opening gear 18.

In the illustrated embodiment, the support transmission assembly 17 includes two transmission gears 170 for engaging with the opening gear 18 and the outer teeth ring 1531 of the ratchet 153 respectively. In order to make the transmission more smooth and the structure more compact, the two transmission gears 170 are arranged symmetrically with respect to the axis of the output shaft of the motor. It may be appreciated that in order to make the transmission more smooth, a plurality of transmission gears may be additionally arranged between the two transmission gears 170 and arranged symmetrically. The support transmission assembly 17 may also be a chain or a cylindrical structure with an outer gear, as long as it can transmit the power of the ratchet 153 to the opening gear 18 and ensure that a portion of the support transmission assembly 17 always engages with the opening gear 18 so as to force the opening gear 18 to rotate smoothly.

Figure 8:
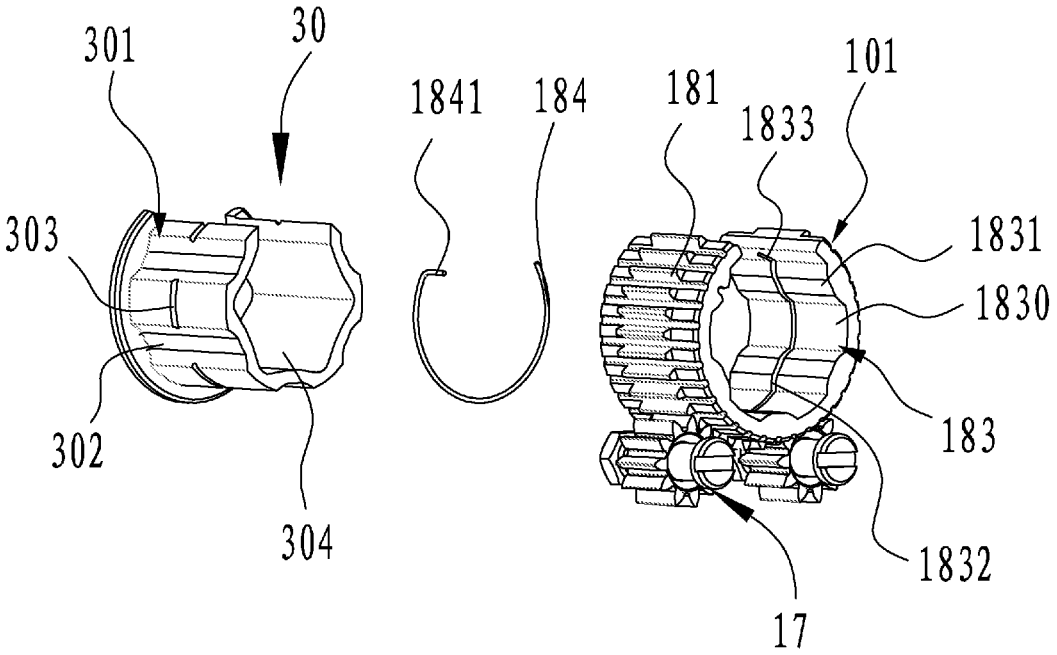
FIG. 8 is schematic view showing an opening gear of the electrical wrench of FIG. 1 and an accessory which is capable of being connected to the opening gear.
Figure 9:
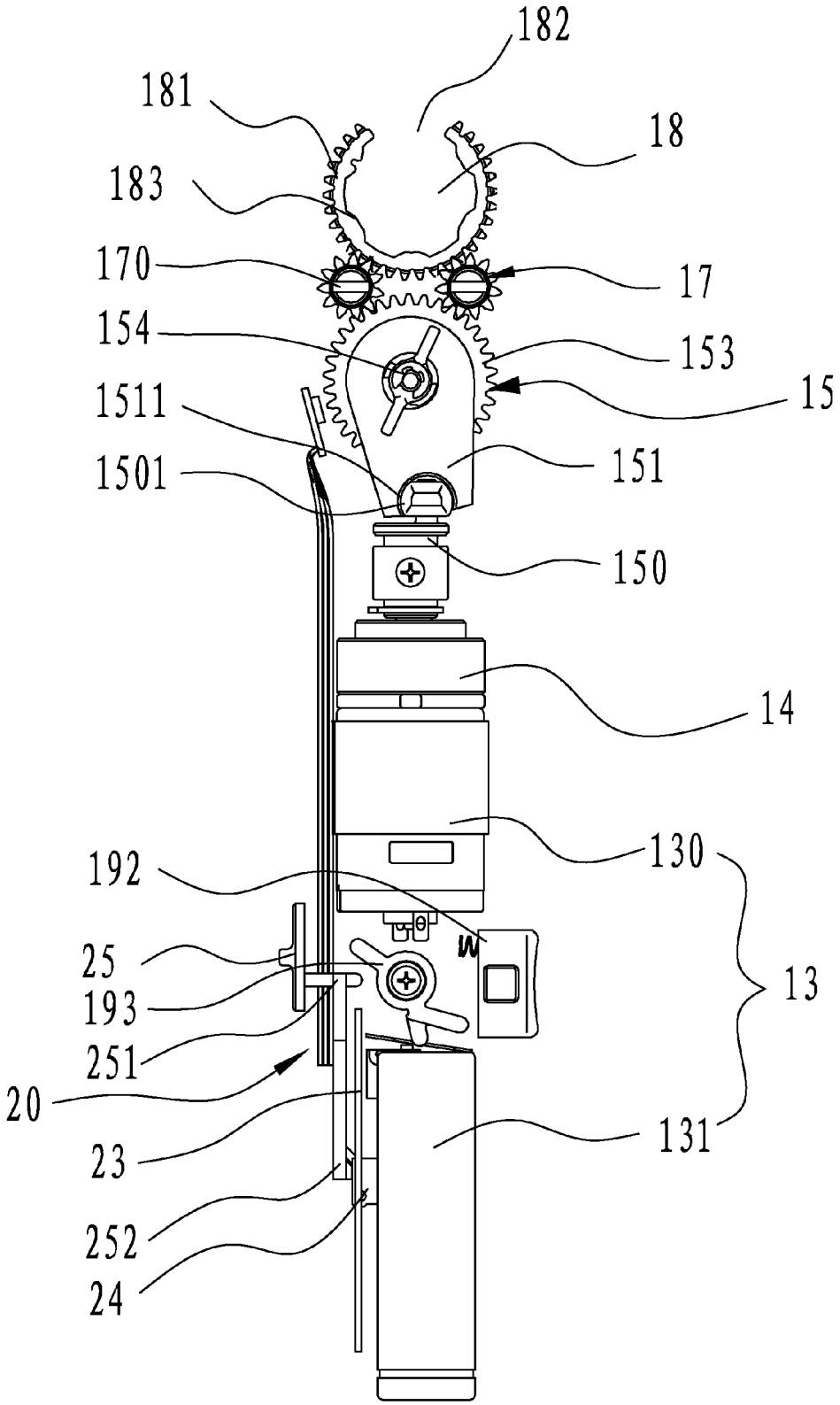
FIG. 9 is a back view of the electrical wrench of FIG. 1 with the housing removed.

Also referring to FIGS. 1, 8 and 9, the opening gear 18 is engaged with the support transmission assembly 17, and rotatably mounted in the mounting portion 1111 of the support housing 111.

The opening gear 18 has an outer teeth portion 181 engaged with the support transmission assembly 17, an opening 182 through which the fastener enters laterally, and a driving portion 183 communicated with the opening 182. The driving portion 183 is configured as an inner sleeve structure having a shape corresponding to the head of the fastener that is to be driven. In order to ensure the stability of the power transmission, the size of the opening of the opening gear 18 is smaller than the maximum engaging distance between the support transmission assembly 17 and the opening gear 18. It should be noted that in order to be suitable for the fasteners with different sizes, the driving portion 183 may be connected with an accessory 30. The accessory 30 may be an opening sleeve or a converter capable of engaging with the fasteners of different sizes. The accessory 30 is connected to the opening gear 18 without rotation by an elastic connecting member 184. The opening gear 18 forces the accessory 30 to rotate so as to tighten or release the fastener arranged in the accessory through the power transmitted by the support transmission assembly 17. In the illustrated embodiment, the driving portion 183 includes an inner engaging surface 1830 and a plurality of ribs 1831 formed on the inner engaging surface 1830. The inner engaging surface 1830 is substantially cylindrical. In order ensure the stability of transmission, the ribs 1851 extends along a direction substantially parallel to a central axis of the opening gear 18 and uniformly distributed on the inner engaging surface 1830. The inner engaging surface defines a receiving groove 1832 in a circumferential direction. The receiving groove 1832 is a substantially C-shaped groove.

The accessory 30 includes an outer engaging surface 301, a plurality of concave portions 302 defined on the outer engaging surface 301 for engaging with the plurality of ribs 1831, and an inner sleeve structure 304 for engaging with the fastener. The outer engaging surface 301 is substantially cylindrical. The concave portions 302 extend along a direction substantially parallel to a central axis of the accessory 30 and are uniformly distributed on the outer engaging surface 301. The outer engaging surface 301 further defines an engaging slot 303 in a circumferential direction corresponding to the receiving groove 1832 of the opening gear 18. The engaging slot 303 includes a plurality of arc-shaped slot portions positioned on the same circle. When the plurality of ribs 1831 are received in the concave portion 302 of the accessory 30, the opening gear 18 is capable of the driving accessory 30 to rotate. It should be noted that the opening gear 18 may also drive the driving accessory 30 by other stop structures which are capable of preventing the accessory 30 from rotating relative to the opening gear 18.

The elastic connecting member 184 is substantially C-shaped and received in a receiving space cooperatively formed by engaging slot 303 of the accessory 30 and the receiving groove 1832 such that the accessory 30 is connected to the opening gear 18 and prevented from moving along an axial direction. The inner engaging surface 1830 of the opening gear 18 further defines a limiting portion 1833 communicating with one end of the receiving groove 1832. In the illustrated embodiment, the limiting portion 1833 is a limiting groove although the limiting portion 1833 may be a limiting hole. One end of the elastic connecting member 184 forms a limiting end 1841 received in the limiting portion 1833, thus preventing the elastic connecting member 184 from detaching from the receiving groove 1832 and avoid interference between the elastic connecting member 184 and the opening 182.

Referring to FIG. 9 again, the main control assembly 19 is used to control the operation of the electrical wrench 10, and includes a main switch 191, a main switch operator 192 and a switch driving member 193.

The restoring assembly 20 is used to align the opening 182 of the opening gear 18 with the entrance 1113. The restoring assembly 20 includes an identifying portion for identifying the position of the opening 182 of the opening gear 18. The identifying portion is arranged at the corresponding position of the opening gear 18 or the reversing mechanism 15 and may be a member having an identifying function, for example, a magnet or a label. It should be noted that the identifying portion may also be an opening or a groove arranged on the opening gear 18 or the reversing mechanism 15. In the illustrated embodiment, the identifying portion is arranged at the corresponding position on the ratchet 153. The restoring assembly 20 further includes a sensor 22 for sensing the position of the identifying portion, a control circuit board 23 connected with the sensor 22, a restoring switch 24 for triggering the restoring function and a restoring switch operator 25. When the restoring switch 24 is in a triggered state, the sensor 22 senses the identifying portion and generates an electrical signal which is transmitted to the control circuit board 23, and the control circuit board 23 controls the electrical wrench 10 to stop rotating. Under the action of the inertia and the resistance, the opening gear 18 continues to rotate and stops rotating at the position where the opening 182 is aligned with the entrance 1113.

In the illustrated embodiment, in order to enhance the comfort of the operation, the main switch operator 192 and the restoring switch operator 25 are oppositely arranged on opposite sides of the handling portion 112 of the housing 11, and the switch driving member 193 is arranged between the main switch operator 192 and the restoring switch operator 25. The control circuit board 23 is provided with a control circuit for controlling the rotation of the motor 130, and the switch driving member 193 may switch on/off the control circuit under the driving action of the main switch operator 192 or the restoring switch operator 25.

The restoring switch operator 25 includes a first lever 251 and a second lever 252 to switch on/off the main switch 191 or the restoring switch 24 respectively by pushing the switch driving member 193. The switch driving member 193 is rotatably mounted to the housing 11, and includes a first rotating arm 1931 and a second rotating arm 1932 which respectively abuts against the main switch operator 192 and the first lever 251 of the restoring switch operator, a linkage member 1933 for driving the main switch 191 to switch on/off and an elastic restoring mechanism. When moving the restoring switch operator 25 and the main switch operator 192, they may force the switch driving member 193 to rotate by the first rotating arm 1931 and the second rotating arm 1932 respectively, thereby forcing the linkage member 1933 to rotate so as to switch on/off the main switch 191.

When moving the restoring switch operator 25, the restoring switch operator 25 triggers the restoring switch 24 by the second lever 252 so that the sensor 22 starts to work, and the restoring switch operator 25 pushes the switch driving member 193 to rotate by the first lever 251 so that the linkage member 1933 can switch off the main switch 191. At that time, the motor 130 is started to force the opening gear 18 to rotate. When the sensor 22 senses the identifying portion, the control circuit is switched off by the control circuit board 23 and the motor 130 stops outputting, and the opening gear 18 continues to rotate under the action of the inertia and the resistance and stops rotating at the position where the opening 182 is aligned with the entrance 1113.

Figure 10:
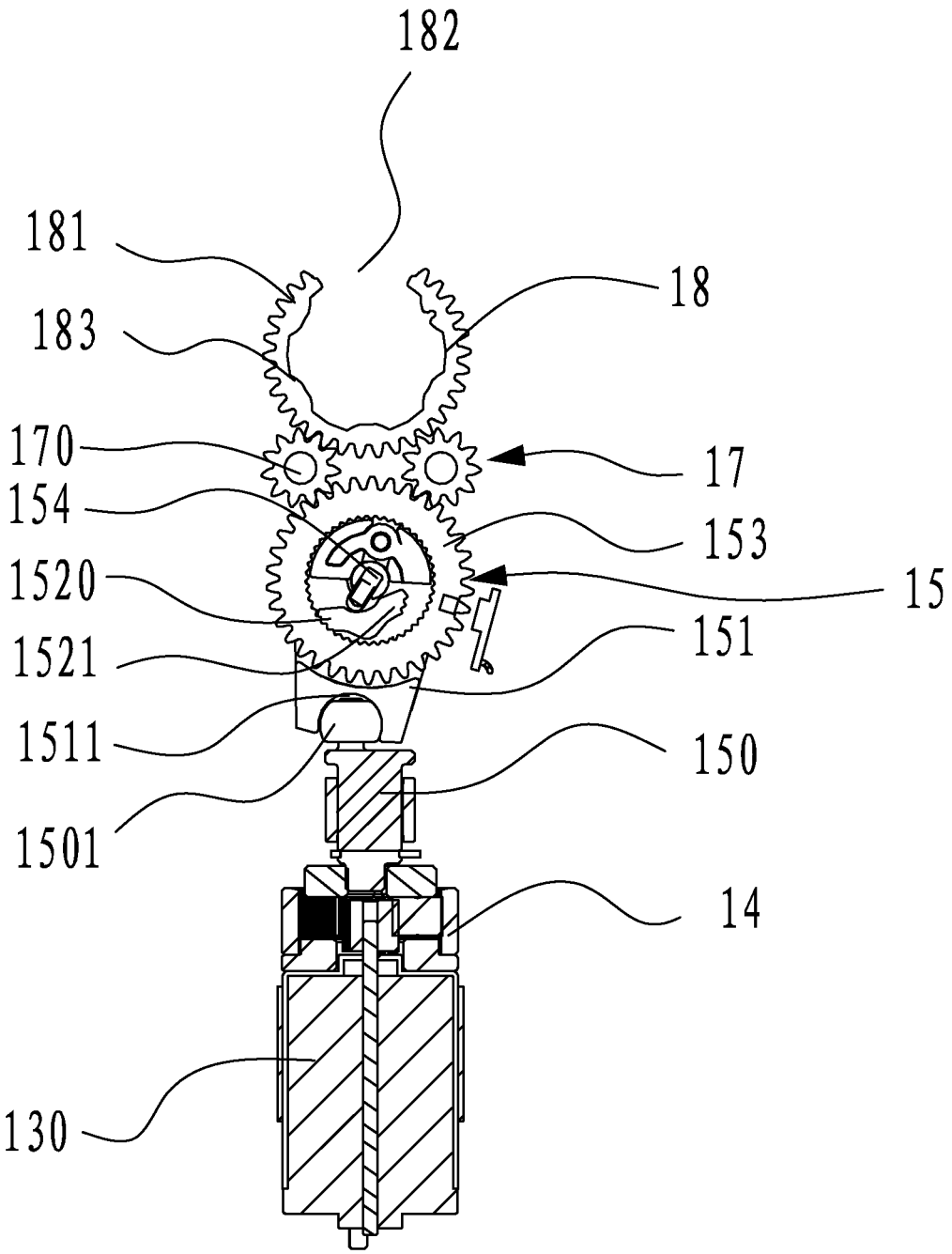
FIG. 10 is a schematic view showing the operation of the opening gear of the electrical wrench of FIG. 1.
Figure 11:
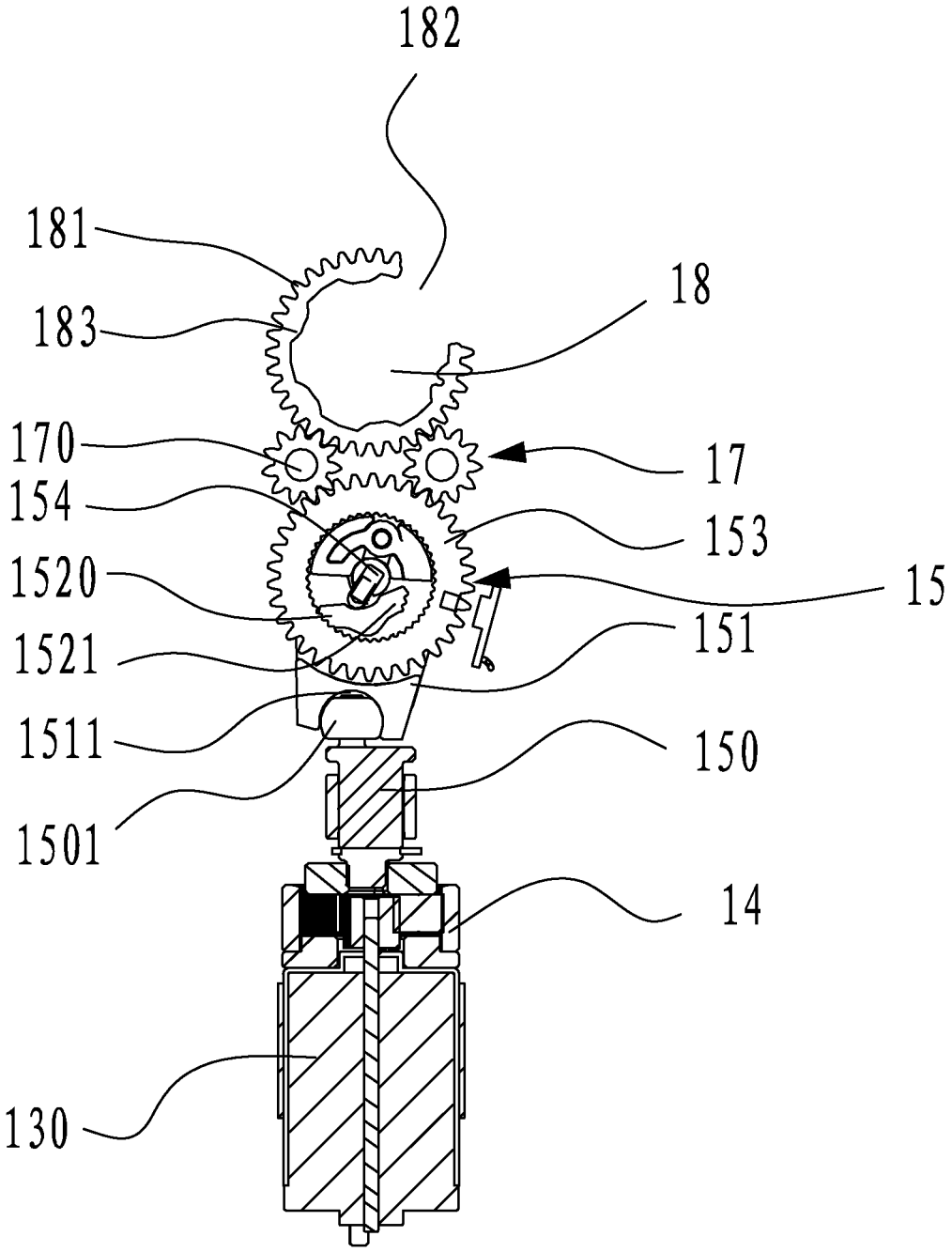
FIG. 11 is a schematic view showing that the opening gear of the electrical wrench of FIG. 1 as operated in another direction.

Referring to FIGS. 10 and 11 at the same time, the working principle of the electric wrench is as follows: the first rotating direction of the opening gear 18 is taken as the direction of tightening the fastener. When tightening the fastener, the restoring procedure is firstly started to adjust the opening 182 of the opening gear 18 to align with the entrance 1113, and the operator causes the object for cooperating with the fastener to pass through the entrance 1113 and enter the opening gear 18 from the opening 182 and mounts the fastener to the driving portion 183 of the opening gear 18. At that moment, the operator 1542 may be rotated so that the elastic assembly 1541 abuts against the first pawl portion 1520, and then the main switch 191 is started, the output shaft of the motor 130 forces the eccentric shaft 150 to rotate eccentrically by the speed reducing mechanism 14. The eccentric shaft 150 is mated with the groove 1511 arranged on the swinging member 151 periodically so as to convert the rotation of the output shaft of the motor along its axis into the periodic swinging motion of the swinging member 151 around the rotating shaft 1540. The pawl 152 is pivotally connected to the swinging member 151 and the ratchet 153 is provided with ratchet teeth 1530 for engaging with the pawl 152, and then the first pawl portion 1520 is driven by the swinging member 151 to rotate in the first rotating direction or in the second rotating direction around the pivoting shaft perpendicular to the plane in which the swinging member is located. When the pawl 152 rotates in the first rotating direction, the first pawl portion 1520 inserts into the ratchet teeth 1530 so as to push the ratchet 153 to rotate in the same direction; and when the pawl 152 rotates in the second rotating direction, the first pawl portion 1520 slips over the ratchet 153 and the ratchet 153 stops rotating, so that the ratchet 153 rotates periodically in the first rotating direction to force the opening gear 18 to rotate in the first rotating direction so as to tighten the fastener.

When the fastener needs to be released, the restoring procedure is firstly started to adjust the opening 182 of the opening gear 18 to align with the entrance 1113, and the operator causes the fastener to pass through the entrance 1113 and enter the opening gear 18 from the opening 182, and mounts the fastener in the driving portion 183 of the opening gear 18. At that moment, the operator 1542 may be rotated so that the elastic assembly 1541 abuts against the second pawl portion 1521, and then the main switch 191 is started, the output shaft of the motor 130 forces the eccentric shaft 150 to rotate eccentrically by the speed reducing mechanism 14. The eccentric shaft 150 is mated with the groove 1511 arranged on the swinging member 151 periodically so as to convert the rotation of the output shaft of the motor along its axis into the periodic swinging motion of the swinging member 151 around the rotating shaft 1540. The pawl 152 is pivotally connected to the swinging member 151 and the ratchet 153 is provided with ratchet teeth 1530 for engaging with the pawl 152. Thus, the second pawl portion 1521 is driven by the swinging member 151 to rotate in the first rotating direction or in the second rotating direction around the pivoting shaft perpendicular to the plane in which the swinging member 151 is located. When the pawl 152 rotates in the second rotating direction, the second pawl portion 1521 inserts into the ratchet teeth 1530 so as to push the ratchet 153 to rotate in the same direction; and when the pawl 152 rotates in the first rotating direction, the second pawl portion 1521 slips over the ratchet 153 and the ratchet 153 stops rotating so that the ratchet 153 rotates periodically in the second rotating direction, thus the accessory 20 is forced to rotate in the second rotating direction by the opening gear 18 so as to release the fastener.

Still referring to FIGS. 10 and 11, the electrical wrench 10 is also provided with a manual operation mode, and the first rotating direction of the opening gear 18 is taken as the direction of tightening the fastener member. When tightening the fastener, the restoring switch 192 is firstly started to adjust the opening 182 of the opening gear 18 to align with the entrance 1113, and the operator causes the object for cooperating with the fastener to pass through the entrance 1113 and enter the opening gear 18 from the opening 182, and mounts the fastener to the driving portion 183 of the opening gear 18. At that moment, the operator 1542 may be rotated so that the elastic assembly 1541 abuts against the first pawl portion 1520. When the housing 11 is rotated manually in the first rotating direction, since the inner transmission mechanisms in the electrical wrench 10 are not locked with each other, the opening gear 18 may rotate relative to the housing 11 in the second rotating direction, so that the ratchet 153 is forced to rotate in the second rotating direction. At that moment, the ratchet teeth 1530 are engaged with the first pawl portion 1520 so as to push the pawl 152 to rotate in the same direction. The pawl 152 forces the swinging member 151 to rotate in the second rotating direction and the swinging member 151 may force the eccentric shaft 150 to rotate in the opposite direction. When the eccentric portion of the eccentric shaft 150 rotates to the dead point engaged with the groove 1511 in the opposite direction, the eccentric shaft 150 may be locked with the swinging member 151 in the opposite direction. At that moment, if the operator continues to rotate the housing 11 in the first rotating direction manually, the opening gear 18 may force the fastener to rotate in the first rotating direction so as to tighten the fastener gradually. Also, the electrical wrench 10 may also be used manually to release the fastener.

The support housing 111 extends from the mounting portion 1111 to the handling portion 112 of the electrical wrench 10, which ensures the torsional strength of the electrical wrench 10 when used manually. Moreover, the reversing mechanism 15 cuts off the power transmission between the opening gear 18 and the output shaft of the motor, thereby efficiently avoiding the reverse rotation of the motor in the manual operation mode.

Figure 12:
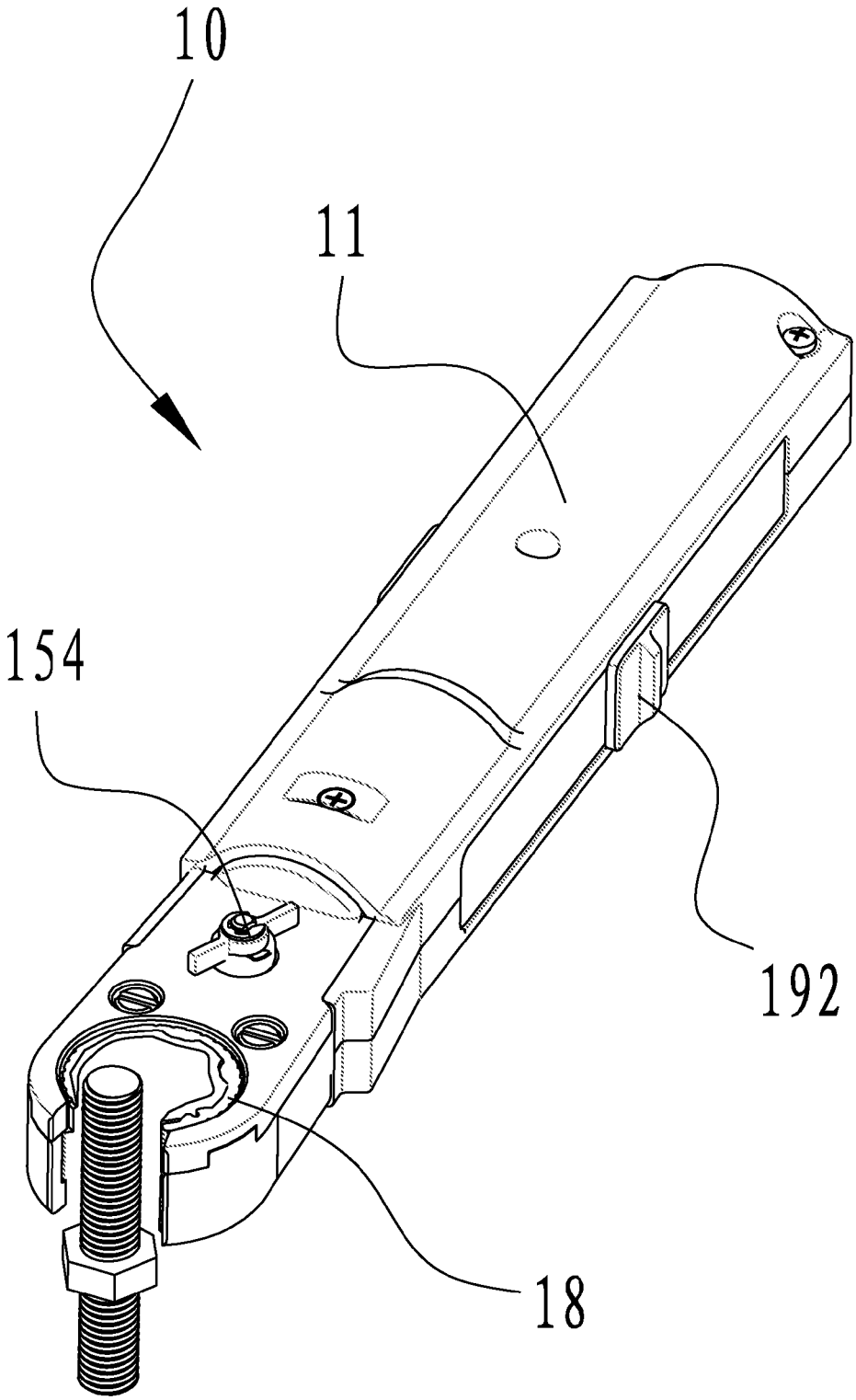
FIG. 12 is a schematic view showing the usage state of the electrical wrench of FIG. 1.

Referring to FIG. 12, with the opening 182 corresponding to the entrance 1113 on the opening gear 18, the fastener may be inserted into the opening gear 18 by the mounting portion 1111 so as to be tightened or released, thus the electrical wrench can be simply used in connection with a relatively long bolt or a nut with a tube. Moreover, the reversing mechanism 15 is used as reversing transmission mechanism and the motor 130 provides power, thus during the operation, the operator only needs to position the fastener into the opening gear 18, and then start the electrical wrench 10 of the present invention, thus the fastener can be tightened or released without rotating the housing 11. The electrical wrench thus has a simple and convenient operation, high working efficiency, and may be simply used in some narrow operating spaces.

The above described embodiments are not intended to restrict the present invention. The person skilled in the art can change or modify the present invention without departing from the spirit and scope of the present invention. The protection scope of the present invention is therefore to be defined by the attached claims.

What is claimed is:

1. An electrical wrench for rotating a fastener, the electrical wrench comprising:

a housing having a handling portion and a mounting portion extending from one end of the handling portion along a length direction, the mounting portion comprising two projections arranged oppositely and the two projections cooperatively defining an entrance therebetween;

a drive assembly comprising a power member, a reversing mechanism, a support transmission assembly, and an opening gear wherein the power member, the reversing mechanism, the support transmission assembly and the opening gear are cooperatively coupled to one another and accommodated in the housing with the opening gear being rotatably arranged in the mounting portion and including an outer teeth portion for engaging with the support transmission assembly, an opening corresponding to the entrance and a driving portion in communication with the opening, wherein a width of the entrance and the opening is greater than or equal to a diameter or width of a tubular or cylinder member that is cooperative with the fastener, and wherein the driving portion is operable to rotate the fastener or an accessory for holding the fastener when positioned within the opening gear;

a main control assembly in communication with the drive assembly; and a restoring assembly wherein the restoring assembly comprises an identifying portion which is arranged in a predetermined position on the opening gear or a predetermined position on the reversing mechanism for use in identifying a position of the opening of the opening gear, a sensor for sensing the position of the identifying portion, a control circuit board connected with the sensor, a restoring switch and a restoring switch operator such that, when the restoring switch is triggered via use of the restoring switch operator, the sensor is used to sense a presence of the identifying member and to generate an electrical signal which is transmitted to the control circuit board so that the control circuit board controls the drive assembly to rotate the opening gear into a predetermined position; and wherein the main control assembly comprises a main switch, a main switch operator, and a switch driving member, wherein the control circuit board is provided with a control circuit for controlling the power member, and wherein the switch driving member is adapted to switch on/off the control circuit under the driving action of the main switch operator and the restoring switch operator.

2. The electrical wrench according to claim 1, wherein the main switch operator and the restoring switch operator are arranged on opposite sides of the handling portion of the housing, wherein the switch driving member is arranged between the main switch operator and the restoring switch operator.

3. The electrical wrench according to claim 2, wherein the restoring switch operator comprises a first lever and a second lever for pushing the switch driving member to switch on/off the main switch and the restoring switch respectively, wherein the switch driving member is rotatably mounted to the housing and comprises a first rotating arm and a second rotating arm abutting against the main switch operator and the first lever of the restoring switch operator respectively, a linkage member for driving the main switch to switch on/off, and an elastic restoring member, and wherein, under the action of the elastic restoring member, the first rotating arm is adapted to abut against the main switch operator or the second rotating arm is adapted to abut against the restoring switch operator.

4. The electrical wrench according to claim 1, wherein the housing is configured as a substantially rod-type structure comprising a main housing extending along a longitudinal direction and a support housing extending from one end of the main housing, wherein a first end of the support housing is fixedly mounted in the main housing and a second end of the support housing opposite to the first end extends out of the main housing along the length direction of the housing, wherein the mounting portion is formed on an end of the support housing away from the main housing and comprises two substantially arc-shaped claws arranged oppositely, and wherein the two claws cooperatively define an accommodating hole communicated with the entrance and the opening gear is received in the accommodating hole.

5. The electrical wrench according to claim 1, wherein the reversing mechanism is one of a ratchet mechanism or a bevel gear mechanism and wherein a speed reducing mechanism is arranged between the power member and the reversing mechanism, by which, after decelerating, the power provided by the power member is transmitted to the reversing mechanism.

6. The electrical wrench according to claim 5, wherein the reversing mechanism is a ratchet mechanism comprising an eccentric shaft, a swinging member, a pawl, and a ratchet, wherein the eccentric shaft is pivotally connected to the support housing and connected with an output shaft of the power member by the speed reducing mechanism, wherein the pawl is pivotally connected to the swinging member, wherein the ratchet comprises an inner ring having a plurality of ratchet teeth for mating with the pawl and an outer ring having an outer teeth ring for engaging with the support transmission assembly, and wherein, under the action of the swinging member, the pawl is capable of being rotated in a first or second direction around a pivoting axis substantially perpendicular to a plane in which the swinging member is located such that, when the pawl rotates in the first direction, the pawl inserts into the ratchet teeth to push the ratchet to rotate in the same direction and, when the pawl rotates in the second direction, the pawl slips over the ratchet so that the ratchet stops rotating.

7. The electrical wrench according to claim 6, wherein the power member comprises a motor and a power supply for providing electrical power to the motor, wherein the speed reducing mechanism is a planet gear speed reducing mechanism comprising a planet gear, an inner teeth ring, a planet carrier and a sun gear, wherein the sun gear is connected to the output shaft of the motor without rotation, wherein the planet gear is engaged with the sun gear and the inner teeth ring respectively, wherein the inner teeth ring is fixedly mounted to the support housing, wherein, under the driving action of the sun gear, the planet gear is capable of being rotated on its own axis to revolve around the output shaft of the motor along the inner teeth ring, wherein the planet carrier is fixedly provided with a projecting planet gear shaft around which the planet gear is rotatably mounted, and wherein the planer carrier is connected to the eccentric shaft without rotation.

8. The electrical wrench according to claim 7, wherein the reversing mechanism comprises a reverser having a rotating shaft, an elastic assembly and an operator, wherein the swinging member is pivotally connected to the support housing by the rotating shaft, wherein one end of the elastic assembly abuts against the rotating shaft and the other end of the elastic assembly abuts against the pawl, wherein the pawl comprises a first pawl portion and a second pawl portion arranged symmetrically with each other along the pivoting shaft, wherein the elastic assembly is adapted to rotate under the action of the rotating shaft and abut against the first pawl portion or the second pawl portion, wherein the operator is connected to the rotating shaft without rotation such that the rotating shaft can be rotated under the action of the operator to change the abutting position of the elastic assembly on the pawl, thereby effecting a reverse action, wherein the rotating shaft defines a positioning hole, wherein the elastic assembly comprises a compression spring and a hollow pin, wherein the compression spring comprises a first end abutting against an inner wall of the hollow pin and a second end received in the positioning hole of the rotating shaft, and wherein the hollow pin abuts against the pawl under the action of the compression spring.

9. The electrical wrench according to claim 8, wherein the swinging member comprises a swinging body and a protection cover for cooperating with the swinging body, wherein the ratchet is arranged between the swinging body and the protection cover, wherein each of the swinging body and the protection cover defines a rotating shaft hole concentric with the ratchet and an assembling hole in which a screw is accommodated so as to fixedly connect the swinging body to the protection cover, wherein the rotating shaft is passed through the rotating shaft holes of the swinging body and the protection cover so that the swinging body and the protection cover can rotate relative to the rotating shaft, and wherein the two ends of the rotating shaft are supported on the support housing and rotatable relative to the support housing.

10. The electrical wrench according to claim 9, wherein at least one of the swinging body and the protection cover comprises a circular boss formed at one side of one of the swinging body and the protection cover adjacent to the other of the swinging body and the protection cover, wherein the rotating shaft hole is arranged in the center of the circular boss, wherein the assembling hole is arranged on the circular boss, wherein the circular boss further defines a pivoting shaft hole for pivotally mounting the pawl, and wherein the pivoting shaft hole and the assembling hole are arranged on opposite sides of the circumferential direction of the circular boss.

11. The electrical wrench according to claim 1, wherein the support transmission assembly comprises two transmission gears, wherein opposed sides of each transmission gear is engaged with the opening gear and the reversing mechanism respectively, wherein a size of the opening of the opening gear is smaller than a maximum engaging distance between the two transmission gears and the opening gear, and wherein a width of the entrance and the opening is greater than or equal to the diameter or the width of the tubular or cylinder member that is cooperable with the fastener.

12. An electrical wrench for rotating a fastener, the electrical wrench comprising:

a housing having a handling portion and a mounting portion extending from one end of the handling portion along a length direction, the mounting portion comprising two projections arranged oppositely and the two projections cooperatively defining an entrance therebetween;

a drive assembly comprising a power member, a reversing mechanism, a support transmission assembly, and an opening gear wherein the power member, the reversing member, the support transmission assembly, and the opening gear are cooperatively coupled to one another and accommodated in the housing with the opening gear being rotatably arranged in the mounting portion and including an outer teeth portion for engaging with the support transmission assembly, an opening corresponding to the entrance and an accommodating portion in communication with the opening, wherein a width of the entrance and the opening is greater than or equal to the diameter or width of a tubular or cylinder member that is cooperative with the fastener;

an accessory for engaging with the fastener, the accessory being mounting in the accommodating portion of the opening gear without rotation, the accommodating portion of the opening gear defining a receiving groove along a circumferential direction, and an outer engaging wall of the accessory defining an engaging slot corresponding to the receiving groove along the circumferential direction; and an elastic connecting member accommodated in a receiving space formed between the receiving groove of the opening gear and the engaging slot of the accessory so as to connect the accessory with the opening gear and to prevent the accessory from moving axially, the opening gear comprising a limiting portion formed on the inner engaging surface of the opening gear at the end adjacent to the receiving groove to communicate with the receiving groove, and the elastic connecting member comprising a limiting end correspondingly arranged on an end of the elastic connecting member and mounted in the limiting portion so as to prevent the elastic connecting member from detaching from the receiving groove.

13. The electrical wrench according to claim 12, wherein the receiving portion comprises an inner engaging surface arranged on an inner side wall of the opening gear, wherein the accessory comprises an outer engaging surface arranged on an outer engaging wall thereof, wherein the inner engaging surface and the outer engaging surface are both substantially cylindrical, wherein the inner engaging surface is formed with a plurality of ribs protruding inwards radially and extending along an axis direction of the opening gear and arranged uniformly on the inner engaging surface of the opening gear, wherein the outer engaging surface is formed with a plurality of concave portions corresponding to the ribs, and wherein the concave portions extend along an axis direction of the accessory and are arranged uniformly on the inner engaging surface of the accessory.

14. The electrical wrench according to claim 12, wherein the accessory is an opening sleeve, wherein the receiving groove is a C-shaped groove, wherein the elastic connecting member is generally C-shaped, and wherein the receiving groove comprises a plurality of arc-shaped grooves arranged on the same circumference.

15. An electrical wrench for rotating a fastener, the electrical wrench comprising:

a housing having a mounting portion at one end thereof, the mounting portion comprising two projections arranged oppositely with the two projections cooperatively defining an entrance therebetween;

a drive assembly comprising a power member, a ratchet mechanism, a support transmission assembly, and an opening gear with the power member, the ratchet mechanism, the support transmission assembly, and the opening gear being cooperatively coupled to one another and accommodated in the housing with the opening gear being rotatably arranged in the mounting portion and comprising an outer teeth portion for engaging with the support transmission assembly, an opening corresponding to the entrance and a driving portion in communication with the opening, wherein a width of the entrance and the opening is greater than or equal to the diameter or width of a tubular or cylinder member that is cooperative with the fastener, wherein the driving portion is operable to rotate the fastener or an accessory for holding the fastener rotate, and wherein power provided by the power member is transmitted to the support transmission assembly through the ratchet mechanism so as to force the opening gear to rotate via the support transmission assembly.

16. The electrical wrench according to claim 15, wherein the housing is configured as a rod-type structure comprising a main housing extending along the longitudinal direction and a support housing extending from one end of the main housing, wherein the support housing is configured with one end fixedly mounted in the main housing and with an on opposite end extending out of the main housing along a length direction of the housing, wherein the mounting portion is formed on the end of the support housing away from the main housing and comprises two generally arc-shaped claws arranged oppositely, and wherein an accommodating hole is in communication with the entrance as formed between the two claws and the opening gear is accommodated in the accommodating hole.

17. The electrical wrench according to claim 15, further comprising a planet gear speed reducing mechanism arranged between the power member and the ratchet mechanism, by which, after decelerating, power provided by the power member is transmitted to the ratchet mechanism.

18. The electrical wrench according to claim 15, wherein ratchet mechanism comprises an eccentric shaft, a swinging member, a pawl and a ratchet, wherein the eccentric shaft is pivotally connected to the support housing and connected with an output shaft of the power member by the speed reducing mechanism, wherein the pawl is pivotally connected to the swinging member, wherein the ratchet comprises an inner ring having a plurality of ratchet teeth for mating with the pawl and an outer ring having an outer teeth ring for engaging with the support transmission assembly such that, under the action of the swinging member, the pawl is capable of being rotated in a first or second direction around a pivoting axis substantially perpendicular to a plane in which the swinging member is located whereby, when the pawl rotates in the first direction, the pawl inserts into the ratchet teeth to push the ratchet to rotate in the same direction and, when the pawl rotates in the second direction, the pawl slips over the ratchet so that the ratchet stops rotating.

19. The electrical wrench according to claim 18, wherein the power member comprises a motor and a power supply for providing electrical power to the motor, wherein the speed reducing mechanism is a planet gear speed reducing mechanism comprising a planet gear, an inner teeth ring, a planet carrier and a sun gear, wherein the sun gear is connected to an output shaft of the motor without rotation, wherein the planet gear is engaged with the sun gear and the inner teeth ring respectively, wherein the inner teeth ring is fixedly mounted to the support housing, wherein, under the driving action of the sun gear, the planet gear is capable of being rotated on its own axis to revolve around the output shaft of the motor along the inner teeth ring, wherein the planet carrier is provided with a projecting planet gear shaft around which the planet gear is rotatably mounted, and wherein the planet carrier is connected to the eccentric shaft without rotation.

20. The electrical wrench according to claim 15, wherein the power member comprises a motor and a power supply for providing electrical power to the motor, wherein the electrical wrench further comprises a control assembly comprising a main switch, a restoring switch, a switch driving member coupled to the main switch and the restoring switch, and a circuit board operable via the main switch and the restoring switch, wherein the main switch and the restoring switch are arranged on opposite sides of the handling portion of the housing with the switch driving member being arranged between the main switch and the restoring switch, and wherein the circuit board comprises a control circuit in communication with the main switch and the restoring switch for controlling the rotation of the motor.

* * * * *